US005743805A

United States Patent [19]

Richter

[11] Patent Number: 5,743,805

[45] Date of Patent: Apr. 28, 1998

[54] GOLF SWING TIMING TRAINER

[76] Inventor: Robert E. Richter, 106 Brookview Ter., Valdosta, Ga. 31605

[21] Appl. No.: 751,887

[22] Filed: Nov. 18, 1996

[51] Int. Cl.[6] ..... A63B 69/36

[52] U.S. Cl. ..... 473/213; 473/221; 473/224; 473/276; 482/124; 482/131

[58] Field of Search ..... 473/212, 213, 473/214, 276, 221, 222, 224; 482/124, 131

[56] References Cited

U.S. PATENT DOCUMENTS

| | | | |
|---|---|---|---|
| 3,350,100 | 10/1967 | Carmines . | |
| 3,400,934 | 9/1968 | Muëhl . | |
| 4,017,086 | 4/1977 | Washburn . | |
| 4,088,318 | 5/1978 | Massman | 473/213 X |
| 4,245,841 | 1/1981 | Owens . | |
| 4,575,089 | 3/1986 | Corbett et al. | 473/214 |
| 5,108,103 | 4/1992 | Rilling . | |
| 5,324,038 | 6/1994 | Sasser . | |
| 5,401,017 | 3/1995 | McDonald et al. . | |
| 5,511,788 | 4/1996 | Manley et al. . | |

*Primary Examiner*—George J. Marlo
*Attorney, Agent, or Firm*—Steven R. Scott

[57] ABSTRACT

A golf swing timing trainer formed, in its preferred embodiments, from (a) a forearm brace that serves as a base for the other operative elements of the device; (b) a generally linear member, which member is pivotally connected to the forearm brace at one of its ends and has a vee shaped notch at its other end which fits against the shaft of a golf club held by the user when said club is cocked in the proper plane for a golf stroke; (c) an adjustable biasing means disposed between said forearm brace and said generally linear member, which biasing means generates an adjustable force proportionate to the angle between the forearm brace and the generally linear member/shaft such that the greatest force is experienced by the user when the shaft is cocked and the least is experienced by the user when it is fully extended; and (d) an audible signal generator that indicates when the shaft is not fully cocked.

26 Claims, 3 Drawing Sheets

GOLF SWING TIMING TRAINER

BACKGROUND-FIELD OF INVENTION

This invention relates to a golf swing training device, specifically to a practice device that attaches to the forearm of the leading arm to be useful in training the golfer to uncock the wrists at the proper point in the downswing of the club, while swinging on the proper plane throughout the backswing and downswing.

BACKGROUND-DESCRIPTION OF PRIOR ART

Viewing a classic photo of a world famous golf professional Ben Hogan, shows his perfection in the delayed wrist-uncocking motion until late in the downswing. Learning to let the natural centrifugal force during the downswing create maximum club-head speed at the point of contact is the key to achieving the desired results. The new sensation is holding the club back during the downswing and not forcing it forward. Most people do not hold back and have prematurely uncocked their wrists before contact, thus losing available club head speed at contact. It is a matter of perfecting timing fully to utilize existing natural abilities.

Inventors created several types of devices to try to simulate this feeling. U.S. Pat. No. 4,245,841 to Owens (1981) discloses a complex device clamping to both the forearm and back of the hand; however, these clamps are prohibitively restrictive to normal hand and wrist movements throughout the golf swing. Both hands rotate about a multiple axis during a normal golf swing, and Owens' device severely restricts proper and normal movement of the clamped hand. Also, the device must be preloaded or latched to supply only breakaway resistive force. The force is not gradually built up and released, but violently released when the swing force is sufficient to overcome the latched force. This is not representative of normal forces in a golf swing, and trains the golfer with improper feelings. There is also nothing inherent to this device to aid the golfer to learn to swing the club in a proper arc throughout the golf swing. U.S. Pat. No. 5,401,017 to McDonald et. al. (1995) also shows a device to control wrist movement about a single axis when released from a latched position. This is also not indicative of normal restraints in a golf swing and trains the golfer with improper feelings.

Still other devices as in U.S. Pat. No. 4,017,086 to Washburn (1977), U.S. Pat. No. 5,511,788 to Manley et. al. (1996) and U.S. Pat. No. 3,400,934 to Muehl (1968) show variations of complex clamping devices to both the forearm and hand. They all also inhibit normal multiple-axis rotation of both hands during a normal golf swing and incorporate ratchets and locks to restrain the wrists in a cocked position. These devices, and McDonald's, also contain nothing inherent to train the golfer to swing the club in a proper arc throughout the golf swing.

Still other devices as in U.S. Pat. No. 5,108,103 to Rilling (1992), U.S. Pat. No. 5,324,038 to Sasser (1994) and U.S. Pat. No. 3,350,100 to Carmines (1967) show variations of devices attached to or in contact with both the forearm and hand. They do not espouse to forcible advance or delay the desired wrist and hand motions during an ideal golf swing. They do purport to give to the golfers' passive feedback of errant motions of the leading hand via audible means during the golf swing. Such devices fail to impart variable resistive force to build positive muscle feedback inherent in the desired movement of a golf swing.

None of the previously referenced patents or any other U.S. or Foreign patents searched in class 473 subclasses 207, 212, 213, 214, 219, 231, 257, or 276, foreign patents in class 273 subclasses 183.1, 187.2, 189R, 191A, and class 482 subclasses 44, 45, 46, 124, 128 contained a variable resistive force feature, nor do they contain the swing arc feature inherent in the instant innovation. While these previous devices have been somewhat useful, they failed to solve the training objective of delaying the wrist uncocking until the proper point in the downswing, and have not received wide acceptance by the public. A less complex, effective training aid is needed.

OBJECTS AND SUMMARY.

Accordingly, besides an avoidance of the disadvantages of the devices of the prior art, the objects and advantages of the golf-swing timing trainer described above, several objects and advantages of the present invention are:

(a) to provide a golf-swing timing trainer that incorporates a simpler clamping device (b) to provide a golf-swing timing trainer that attaches only to the forearm and not to the hand or wrist thereby allowing completely natural movement of both hands and wrists throughout the golf swing (c) to provide a golf-swing timing trainer that provides a gradually built and released force rather than an unnatural violent breakaway resistive force (d) to provide a golf-swing timing trainer that provides a portable inherent aid to the golfer to learn to swing the club within a proper arc or plane throughout the golf swing. This feature results in having the club face contact the ball "squarer" at impact, thus imparting less sidewards spin to the ball. The positive result is a ball that tends both to slice and hook less.

(e) to provide a golf-swing timing trainer that provides a force pushing the club head forward, thus training the golfer to hold back.

(f) to provide a golf-swing timing trainer that enables the golfer to practice and train in slow motion and still receive the benefits of the constant force pushing the club head forward thus training the golfer to hold back. The device is adjustable to the varying degrees of centrifugal force produced in the swings of different golfers and different golf shots.

(g) to provide a golf-swing timing trainer that enables the golfer to practice and train in a static arm movement position and still receive the benefits of the constant force pushing the club head forward thus training the golfer to hold back (h) to provide a golf-swing timing trainer that enables the golfer to adjust the amount of force as muscles build in both hands and wrists. Increasing physical strength by exercising and improved equipment only enhances results, but are not required.

(I) to provide a golf-swing timing trainer with a forearm bracing device that is easily adjustable to adapt to various forearm sizes (j) to provide a golf-swing timing trainer that provides an adjustable-volume audible device to advise the golfer when the wrists have begun to uncock.

Further objects and advantages of the invention are to provide an improved training device for use by golfers in perfecting their golf swing for the driver, woods and iron shots. Yet another objective is to provide an efficient device of the kind contemplated which is relatively simple to manufacture and assemble. With practice and training, the golfer may then develop a natural swing that may be consummated without the aid of the training device.

All of the foregoing objects are accomplished by the provision of a device formed, in its most basic embodiments, from a forearm brace that serves as a base for the other operative elements of the device; (a) a generally linear member, which member is pivotally connected to the forearm brace by one of its ends and has a vee shaped notch at its other end that fits against the shaft of a golf club held by the user when said club is cocked in the proper plane for a golf stroke; and (b) a biasing means disposed between said forearm brace and said generally linear member, which biasing means generates a force proportionate to the angle between the forearm brace and the generally linear member/shaft such that the greatest force is experienced by the user when the shaft is cocked and the least is experienced by the user when it is fully extended. In its preferred embodiments it also includes a biasing force adjustment means, means indicating the magnitude of the force exerted by the biasing means, and/or a buzzer (or other audible signal generator) to indicate when the shaft is not fully "cocked".

Still further objects and advantages will become apparent from a consideration of the ensuing description and drawings.

DRAWING FIGURES

In the drawings, closely related figures have the same number but different alphabetic suffixes.

Reference Numerals in Drawings

| | | | |
|---|---|---|---|
| 10 | training device | 12 | force generator |
| 14 | linear support member | 16 | energy connecting element |
| 18 | spring holder | | |
| 22 | nut | 20 | spring |
| 26 | force pin | 24 | adjusting cap |
| 30 | U clamp | 28 | anti friction bushing |
| 34a&b | Velcro ™ straps | 32 | pivot pin |
| 38 | power window scale | 36 | forearm cushion |
| 42 | alarm buzzer | 40 | power window cover |
| 60 | forearm brace | 44 | alarm buzzer circuit |
| 64 | biasing means | 62 | force generator housing |
| 72 | hole in support member | 70 | hole in force generator |
| 76 | shank | 74a&b | shaft interfacing means |
| 80 | club shaft | 78 | shaft guide end of support member |
| 84 | thread | | |
| 88 | hole | 82 | force end of support member |
| 92a&b | external guides | | |
| 96 | male thread | 86 | guide hole |
| 100 | sliding end of adjusting cap | 90a&b | internal guides |
| | | 94 | power window opening |
| | | 98 | female thread |
| | | 102 | enlarged end of biasing means |

SUMMARY OF THE INVENTION

This new training device enables the golfer to experience the feeling of keeping the wrists cocked until the last moment before impact, thus producing maximum club head speed at contact with the ball. The device works equally well at various swing speeds. It accomplishes this while guiding and providing positive feedback that the club is in the proper swing plane. It is designed to impart the feelings to muscle memory.

DESCRIPTION—MAIN EMBODIMENT—FIGS. 1 to 5

Figure 1:
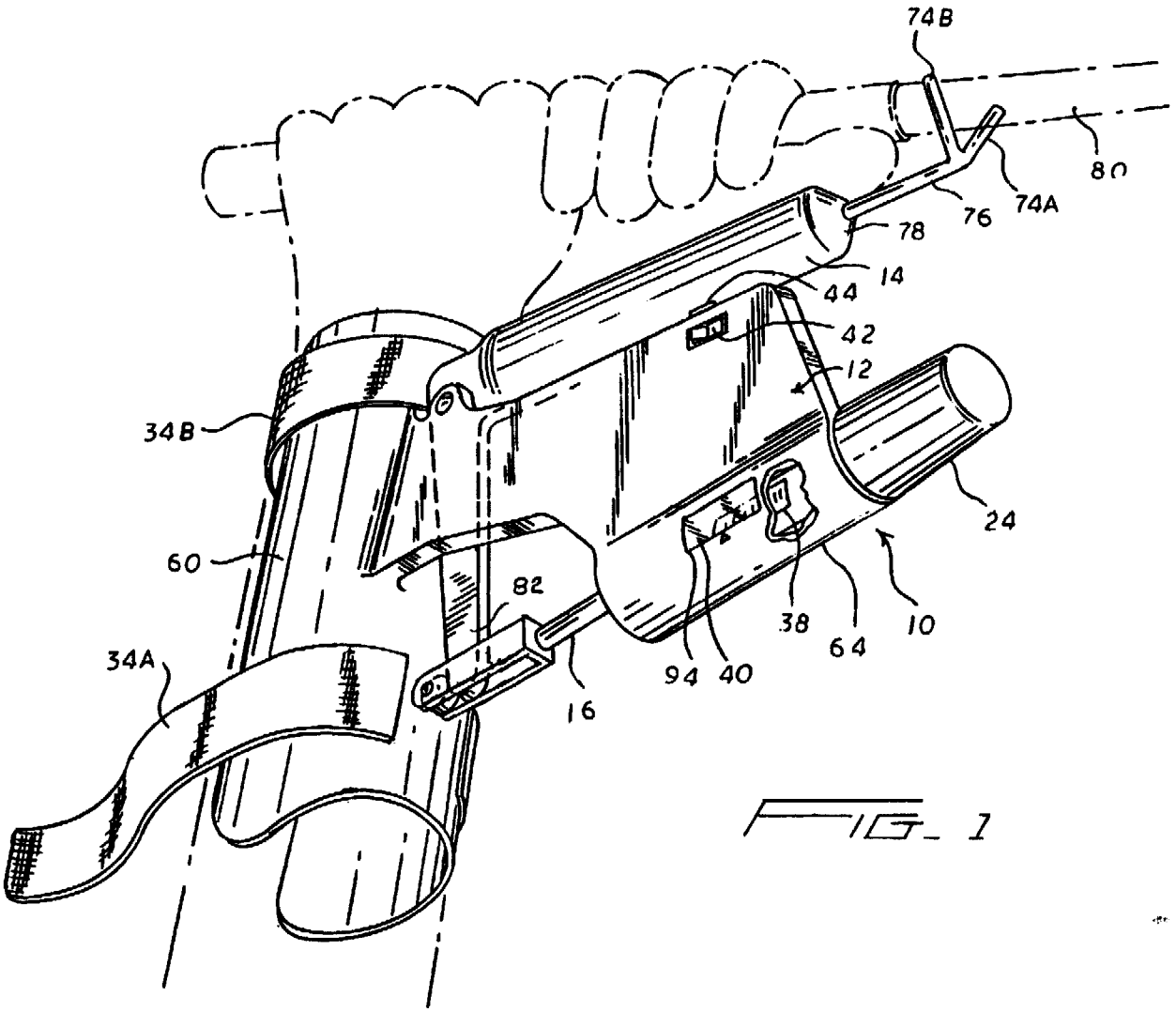
FIG. 1 is an isometric view of a golf-swing timing trainer (GSTT) embodying the principles of the invention. It is shown attached to the golfer's leading arm.
Figure 2:
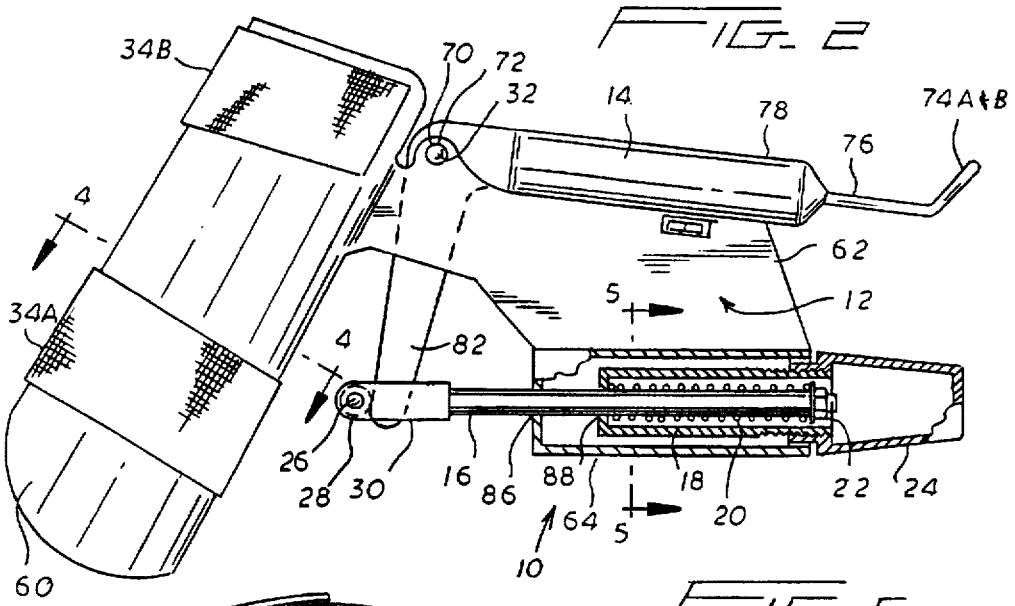
FIG. 2 is a plan view of the device of FIG. 1 shown in its high energy cocked position.
Figure 4:
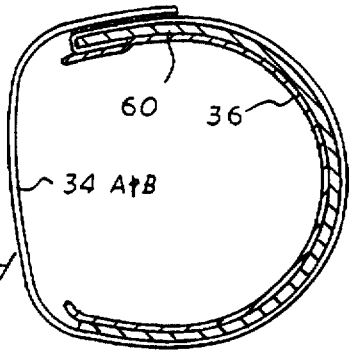
FIG. 4 is a sectional view thru the forearm brace of the device as seen along lines 4—4 in FIG. 2.
Figure 3:
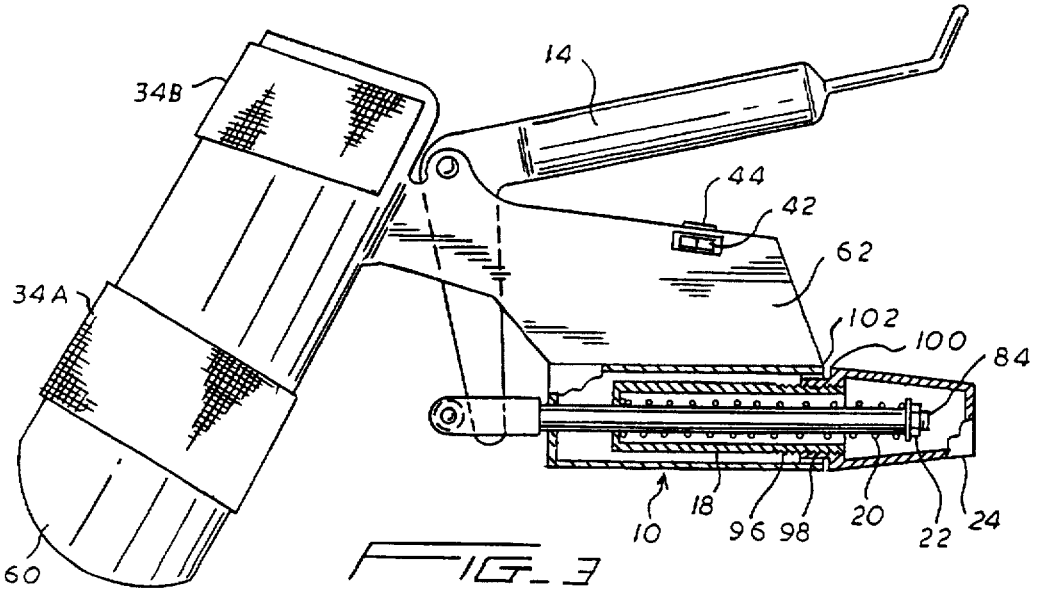
FIG. 3 is a plan view of the device of FIG. 1 shown in its low energy uncocked position.

A typical embodiment of the golf-swing timing trainer of the present invention is illustrated in FIGS. 1–3, wherein the device is generally designated as a training device 10. It includes a force generator 12, a pivot arm or linear support member 14 that is pivotably connected to force generator 12, and an energy connecting element 16. The energy connecting element 16 is urged into a spring holder 18 by the internal compressive force of spring 20 as seen in FIGS. 2&3. A nut 22 on the end of energy connecting element 16 restrains one end of spring 20 while spring holder 18 restrains the opposite end. As linear support member 14 is moved away from its low energy uncocked position, as viewed in FIG. 3 described above, spring 20 is compressed and exerts an increasing force onto linear support member 14. The force is transmitted through a U clamp 30, an anti-friction bushing 28, a force pin 26, and into a force end 82 of linear support member 14 as seen in FIG. 2. The external force onto linear support member 14 is a club shaft 80, as seen in FIG. 1, shown pushing against shaft guide end 78 of linear support member 14 through shaft interfacing means 74*a*&*b* and a shank 76.

The external and internal forces pivot about a pivot pin 32, as shown in FIG. 2. The compressed spring force exerted against spring holder 18 is transferred to biasing means 64 of force generator 12, which in turn transmits it through force generator housing 62 of force generator 12, and lastly into a forearm brace 60 of force generator 12. The forearm of the golfer resists the force in an equal and opposite direction. The forearm brace 60 of force generator 12 is secured to the golfer's forearm by Velcro ™ straps 34*a*&*b*. A forearm cushion 36 material is located between forearm brace 60 and the golfer's forearm for added comfort. The Velcro ™ straps 34*a*&*b* are pulled sufficiently tight to conform the forearm brace 60 to the golfer's forearm before fastening.

Figure 5:
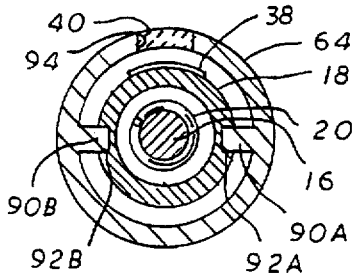
FIG. 5 is a sectional view thru the biasing means of the device as seen along lines 5—5 in FIG. 2.

The amount of initial compressive force can be adjusted by lengthening or shortening the length of spring 20 as seen in FIGS. 2&3. Rotating an adjusting cap 24 lengthens or shortens the spring 20 length by retracting or extending spring holder 18 within biasing means 64. The relative location of spring holder 18 within biasing means 64 can be observed through a power window opening 94 seen in FIGS. 1&5. A calibrated power window scale 38 is attached to spring holder 18. A clear power window cover 40 is forcibly retained by a friction fit into power window opening 94. To prevent spring holder 18 from rotating when adjusting cap 24 is moved, an internal guides 90*a*&*b*, as seen in FIG. 5, are provided inside biasing means 64 along with an external guides 92*a*&*b* on spring holder 18. The guides are designed to allow linear adjustment of spring holder 18. A male thread 96, as seen in FIG. 3, is provided on spring holder 18 to engage a female thread 98 on adjusting cap 24 to provide linear movement of spring holder 18 when adjusting cap 24 is rotated. A sliding end 100 of adjusting cap 24 is sized and designed to engage end 102 of biasing means 64.

Energy-connecting element 16 is restrained to linear motion by contact with a guide hole 86 in biasing means 64 and a hole 88 in spring holder 18 as best seen in FIG. 2. A thread 84 on energy connecting element 16 secures nut 22 on energy connecting element 16 as seen in FIG. 3. U clamp 30 is secured to energy connecting element 16 to prevent energy connecting element 16 from turning when nut 22 is being installed or removed as seen in FIG. 2. Force pin 26 is secured by enlarging its ends and anti-friction bushing 28 is sized to allow rotation around force pin 26 as the force end 82 of linear support member 14 pushes against it. Pivot pin 32 extends thru a hole 70 in the force generator 12 and a hole 72 in linear support member 14. It, too, is restrained from removal by enlarging its ends.

An alarm buzzer 42, as seen in FIGS. 1&3, is secured to force generator housing 62 in close proximity to the edge furthest from biasing means 64. An alarm buzzer circuit 44 is secured to linear support member 14 in a position to allow circuit completion when linear support member 14 is in it high energy position that is best viewed in FIGS. 1&2. When linear support member 14 moves away from its high energy position, as shown in FIG. 3, the circuit is broken and the buzzer noise is activated.

OPERATION—MAIN EMBODIMENT—FIGS. 1&6–8

The manner of using the golf-swing timing trainer described herein assumes the golfer to be right-handed. The leading arm is the left arm. The golfer attaches the train ing device 10 to the forearm of their left arm in an arrangement such that the center line of the linear support member 14 is approximately 20 degrees clockwise from the centerline of the leading arm and club, as viewed by the golfer, while addressing the ball, as may be seen in FIG. 6. The forearm brace 60 is positioned slightly above the wrist to assure complete freedom of movement of the left wrist throughout the swing as seen in FIG. 1. The forearm brace 60 is flexible enough to conform to the forearm of the person using the training device 10.

Figure 7:
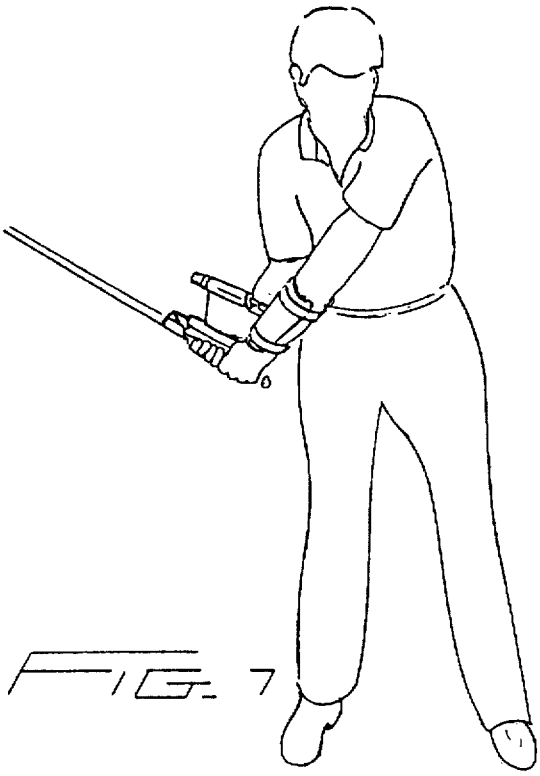
FIG. 7 is an isometric view of a golfer with the device in the backswing and downswing positions.

As the golfer starts the back swing, there comes a point at which the club shaft contacts the shaft interfacing means **74*a&b* as best seen in FIGS. 1&7. If the golfer advances the club on the proper arc of the golf swing, the shaft contacts shaft interfacing means 74*a&b* simultaneously. This is the desired movement. However if the golfer advances the club on an improper arc, the shaft contacts only one of the shaft interfacing means 74*a&b*, and the club is guided into the proper position, thus giving positive and immediate feedback of the desired swing plane. Extreme variances from the proper swing plane result in the club shaft missing the shaft interfacing means 74*a&b*** and also supplies immediate feedback of an improper swing to the golfer.

The golfer continues the normal back swing after proper engagement of the golf club in the shaft interfacing means **74*a&b* as viewed in FIG. 1&7. Resistance is encountered as the back swing advances, and gradually builds as the back swing advances to a full and natural wrist-cocked position. The hands, wrists and arms do nothing out of the ordinary except to overcome the resistive force supplied by the biasing means. The shaft interfacing means 74*a&b* in FIG. 1** gives positive reinforcement of staying on the correct swing arc throughout the back swing.

As the wrists and hands reach their fully-cocked position during the back swing, the shaft guide end 78 of linear support member 14 contacts the portion of the force generator housing farthest away from the biasing means 64 best viewed in FIG. 1. When this happens, the alarm buzzer 42 contacts the alarm buzzer circuit 44 shown in FIGS. 1&3. As long as the circuit is contacted, the buzzer noise is silenced. The silencing of the buzzer noise is another positive and immediate feedback of a properly executed back swing and the downswing. This alarm feature can easily be activated and deactivated by the user. In this position the forward push on the golf club is at its static maximum.

As the golfer starts a normal downswing, as viewed in FIG. 7, gravitational, kinetic and, centrifugal energy is imparted into the club head, and the club reaches an acceleration force that most golfers cannot physically resist. If this happens too early in the downswing, because of prematurely uncocking the wrists, maximum club head speed is realized before contact with the ball and the desired golf ball distance is reduced. Most golfers have hit the ball noticeably further at times and have not realized the reason for their accomplishment. It is usually derived from improved timing in the location of wrist release resulting in maximum club head speed at impact. The golfer has to maintain backwards exertion during the downswing to keep the wrists in a fully cocked position to achieve maximum club speed at the point of contact with the ball. The golfer must maintain the hands and wrists in the fully cocked position until late in the downswing as shown in FIG. 7. This device enables building muscle memory of what needs to be done during the downswing to obtain maximum energy-transfer to the ball.

This device enables the golfer to train in normal or slow speed. The compressed spring force built into the device simulates the centrifugal force generated during a normal swing. It provides this force while in slow motion and allows the golfer to feel the proper hand and wrist cocked position throughout the downswing. To maintain this position, the golfer will naturally bring the right elbow close to the body and perfect the desired inside-to-outside swing path on the desired swing arc. If the golfer uncocks the hands and wrists too early, the buzzer alarm is activated, and the golfer receives immediate and positive feedback. The golfer can practice and train repeatedly the proper back swing and downswing motion in normal or slow speeds with positive and immediate feedback on maintaining the proper swing plane and proper hand and wrist cocking and uncocking motion. This device allows the feeling to last much longer than during the split second in a normal full swing, thus working to help build the desired muscle memory.

A benefit of the device is the building of muscles in the hands, wrists and forearms by repeatedly overcoming the spring force in the device. Although this is a positive attribute of using the device, building muscle only enhances the benefits learned of the proper timing of the release of the hands and wrists in the downswing.

What is especially unique about this new device is that it works a set of muscles exactly opposite to the ones most golfers think of using, and use, to try to hit the ball further. In reality the harder most golfers try to swing the club, the sooner they break their wrists, thus creating maximum club head speed too early in the downswing. This device works at perfecting the timing of the swing to allow maximum club head speed at impact and not before. It works synergistically with all makes of clubs. The better the equipment, the better the results with the GSTT.

One of the GSTT's primary constituents is a force, supplied by spring 20, pushing the club toward the impact zone. With wrists still cocked during the downswing, the individual has to exert an opposite force to maintain the wrists in a cocked position to "arms vertical" in the impact zone as viewed in FIG. 6. This device enables building muscle memory of what needs to be done during a normal full swing.

Figure 6:
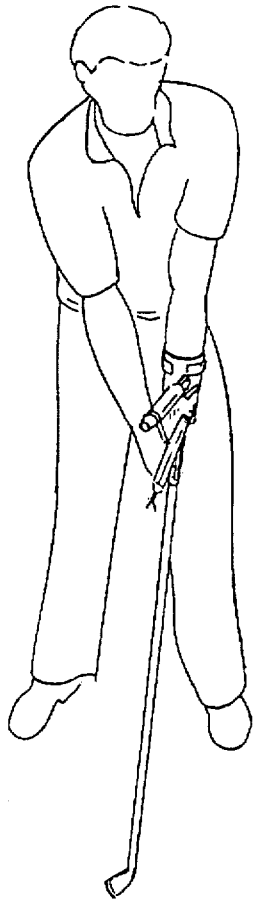
FIG. 6 is an isometric view of a golfer with the device at the take-away and impact positions
Figure 8:
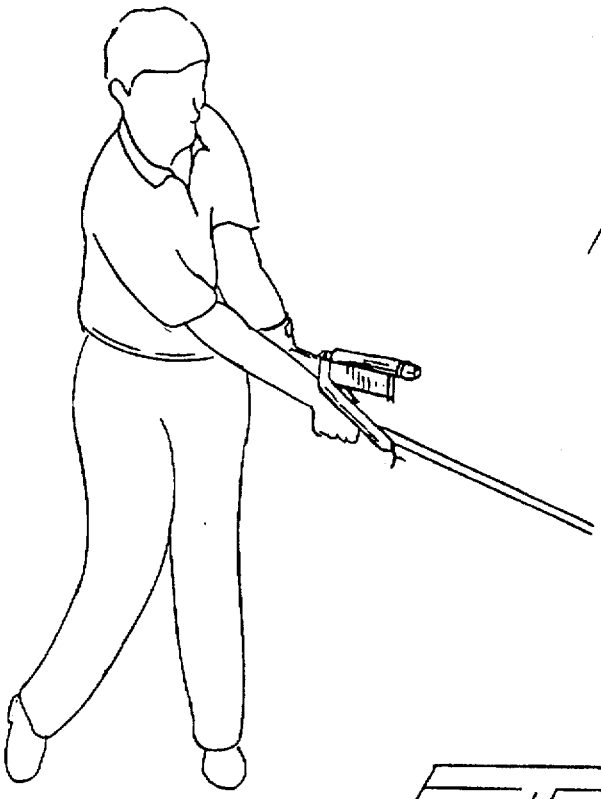
FIG. 8 is an isometric view of a golfer with the device in the follow thru position.

Important objects of the present invention include; the provision of a training aid for golfers to assist the arm muscles in controlling club travel during its downward swing; the provision of a training aid that, besides helping club control, permits normal arm, wrist and hand movements throughout the golf swing as shown in FIGS. 6–8; the provision of a training aid fully adaptable to a wide range of golfers and to golf swing variations for different clubs; the provision of a training aid of lightweight construction to not distract the golfer when in place on the arm; and the provision of a training aid facilitating the development of muscle memory for the golfer's arms, wrists and hands.

As the golfer practices their swing with the device, they will shortly become aware of the position during the downswing at which they have a tendency to release their hands and wrists and accordingly will, if the need arises, gradually adjust their swing and wrist movement to the proper point in time of the downswing and to the end that the device is no longer needed for corrective purposes. If the golfer desires to maximize or reduce the forces deterrent to uncocking the hands and wrists, they may adjust the mechanism by manipulating the adjusting cap 24 as best viewed in FIG. 1.

CONCLUSION, RAMIFICATIONS, AND SCOPE

Accordingly, the reader will see that the golf-swing timing trainer of this invention enables the golfer to become aware of the position of their arms, hands and wrists during the backswing and downswing. The golfer will rapidly adjust their swing through the features of positive and immediate feedback. The device will quickly no longer be needed for corrective purposes but will continue to be useful in reinforcing proper muscle memory and building muscle strength. Furthermore, the golf-swing timing trainer has additional advantages in that

- it provides a means to physically perfect the desired timing of wrist-uncocking both with and without audible feedback.
- it provides a portable means to physically perfect the proper alignment of the swing in the proper arc both in the backswing and downswing
- it provides the means to physically feel and perfect the proper inside-to-outside club head direction by forcing the golfer to bring their right elbow close to the torso during the downswing.
- it permits the golfer to build muscle strength by use as an exercise device Although the description above contains many specificities, these should not be construed as limiting the scope of the invention but as merely providing illustrations of some of the presently preferred embodiments of this invention. For example, the force generator, linear support member, etc. can have other shapes. The force generator can consist of separate pieces and joined by connecting devices; the pivot pins can be replaced by hinges that connect two otherwise unconnected halves, the parts can be made from various materials including plastic and metal, the device can be made opposite hand for left-handed golfers, etc.

Thus the scope of the invention should be determined by the appended claims and their legal equivalents, rather than by the examples given.

I claim:

1. A golf swing timing trainer device for attachment to a human forearm, said human forearm having an upper side, a lower side, a wrist end at which Ulna and Radius forearm bones terminate, and an elbow end, the ends of the Ulna and Radius forearm bones at the wrist end and the elbow end defining a forearm plane containing a forearm axis extending through elbow end and wrist end, the upper side of said forearm being above and defining the upper side of said forearm plane and the lower side of said forearm being below and defining the lower side of said forearm plane, comprising:

(a) a releasable forearm attachment means, said releasable forearm attachment means having a generally planar member and releasable attachment means for releasably attaching said generally planar member to a human forearm, said generally planar member having an extended concave planar configuration with a concave inward surface adapted for placement adjacent a human forearm, an outward surface opposite said inward surface, a first end adapted for placement proximate the wrist of a human forearm and a second end opposite said first end; and (b) a generally rigid member, said generally rigid member having a contact end that is rigidly affixed to the outward surface of said generally planar member and an interface end distant from said generally planar member, said interface end being provided with golf club shaft interfacing means, said interface end and a forearm axis of a human forearm placed adjacent said inward surface defining a club shaft placement plane, which club shaft placement plane is at a selected angle below a forearm plane of a human forearm placed adjacent said inward surface.

2. A golf swing timing trainer device as described in claim 1, wherein said generally rigid member is not rigidly affixed to the outward surface of said generally planar member, but is pivotally affixed thereto such that the interface end of said generally rigid member describes an arc of rotation in said club shaft placement plane when said generally rigid member is rotated about said contact end, said interface end being movable in said arc of rotation between a first position and a second position; and further comprising biasing means connected between said releasable forearm attachment means and said generally rigid member, said biasing means exerting a biasing force urging the generally rigid member away from said first position and toward said second position.

3. A golf swing timing trainer device as described in claim 2, wherein the magnitude of said biasing force is greatest at said first position and least at said second position.

4. A golf swing timing trainer device as described in claim 3, wherein said biasing means is a spring.

5. A golf swing timing trainer device as described in claim 3, further comprising bias adjustment means for adjusting the magnitude of the biasing force provided by said biasing means.

6. A golf swing timing trainer device as described in claim 4, further comprising indicator means for indicating the magnitude of the biasing force provided by said biasing means.

7. A golf swing timing trainer device as described in claim 2, wherein said biasing means is a spring.

8. A golf swing timing trainer device as described in claim 2, further comprising bias adjustment means for adjusting the magnitude of the biasing force provided by said biasing means.

9. A golf swing timing trainer device as described in claim 7, further comprising indicator means for indicating the magnitude of the biasing force provided by said biasing means.

10. A golf swing timing trainer device as described in claim 2, further comprising an activatable aural signal generator that generates an audible signal when the interface end moves from said first position.

11. A golf swing timing trainer device as described in claim 2, wherein the selected angle of said club shaft placement plane is approximately 30 degrees.

12. A golf swing timing trainer device as described in claim 11, wherein the magnitude of said biasing force is greatest at said first position and least at said second position.

13. A golf swing timing trainer device as described in claim 12, wherein said biasing means is a spring.

14. A golf swing timing trainer device as described in claim 12, further comprising bias adjustment means for adjusting the magnitude of the biasing force provided by said biasing means.

15. A golf swing timing trainer device as described in claim 13, further comprising indicator means for indicating the magnitude of the biasing force provided by said biasing means.

16. A golf swing timing trainer device as described in claim 11, wherein said biasing means is a spring.

17. A golf swing timing trainer device as described in claim 11, further comprising bias adjustment means for adjusting the magnitude of the biasing force provided by said biasing means.

18. A golf swing timing trainer device as described in claim 16, further comprising indicator means for indicating the magnitude of the biasing force provided by said biasing means.

19. A golf swing timing trainer device as described in claim 11, further comprising an activatable aural signal generator that generates an audible signal when the interface end moves from said first position.

20. A golf swing timing trainer device as described in claim 11, wherein said golf club shaft interfacing means is open on three sides and closed on three sides.

21. A golf swing timing trainer device as described in claim 2, wherein said golf club shaft interfacing means is open on three sides and closed on three sides.

22. A golf swing timing trainer device as described in claim 2, further comprising an activatable aural signal generator that generates an audible signal when a club shaft is removed from the interface end.

23. A golf swing timing trainer device as described in claim 1, wherein the selected angle of said club shaft placement plane is approximately 30 degrees.

24. A golf swing timing trainer device as described in claim 23, further comprising an activatable aural signal generator that generates an audible signal when a club shaft is removed from the interface end.

25. A golf swing timing trainer device as described in claim 23, wherein said golf club shaft interfacing means is open on three sides and closed on three sides.

26. A golf swing timing trainer device as described in claim 1, wherein said golf club shaft interfacing means is open on three sides and closed on three sides.

* * * * *